United States Patent [19]

Ohkumo

[11] Patent Number: 4,633,831

[45] Date of Patent: Jan. 6, 1987

[54] FUEL CUTOFF SYSTEM FOR A MOTOR VEHICLE

[75] Inventor: Hiroya Ohkumo, Koganei, Japan

[73] Assignee: Fuji Jukogyo Kabushiki Kaisha, Tokyo, Japan

[21] Appl. No.: 801,986

[22] Filed: Nov. 26, 1985

[30] Foreign Application Priority Data

Nov. 30, 1984 [JP] Japan ..... 59-253859

[51] Int. Cl.[4] ..... F01D 41/22

[52] U.S. Cl. ..... 123/325; 123/198 D

[58] Field of Search ..... 123/325, 198 D

[56] References Cited

U.S. PATENT DOCUMENTS

| | | | |
|---|---|---|---|
| 4,440,127 | 4/1984 | Virgilio | 123/325 |
| 4,491,113 | 1/1985 | Gässler et al. | 123/325 |
| 4,510,902 | 4/1985 | Tsuchida et al. | 123/325 |
| 4,528,952 | 7/1985 | Flaig et al. | 123/198 D |
| 4,572,126 | 2/1986 | Arnold et al. | 123/325 |

FOREIGN PATENT DOCUMENTS

| | | | |
|---|---|---|---|
| 65720 | 5/1977 | Japan . | |
| 99431 | 7/1977 | Japan . | |
| 32947 | 2/1983 | Japan | 123/325 |

*Primary Examiner*—William A. Cuchlinski, Jr.
*Attorney, Agent, or Firm*—Martin A. Farber

[57] ABSTRACT

A system has an accelerator pedal switch for sensing the deceleration of a motor vehicle, an electronic circuit operative to cutoff fuel at deceleration of the motor vehicle in order to reduce fuel consumption of an engine. When the switch closes by the failure of the switch, the electronic circuit operates to continue the supply of fuel in order to prevent the stall of the engine.

3 Claims, 3 Drawing Figures

FUEL CUTOFF SYSTEM FOR A MOTOR VEHICLE

BACKGROUND OF THE INVENTION

The present invention relates to a fuel cutoff system for an engine of a motor vehicle at the deceleration of the vehicle.

When a vehicle is decelerating, it is preferable to cutoff fuel so as to decrease fuel consumption. FIG. 3 shows a block diagram describing a conventional fuel cutoff system disclosed in Japanese Utility Model Laid-Open Nos. 52-99431 and 52-65720. The system comprises an accelerator switch, clutch switch, neutral switch provided in a transmission, other signal generators responsive to factors such as coolant temperature and engine speed, and a control circuit for controlling a fuel cutoff solenoid provided in an idle system in a carburetor or fuel injectors. When an accelerator pedal and a clutch pedal of a vehicle are released and one of the gears in the transmission is in engagement with another gear during deceleration, the above described switches are closed. Accordingly, the control circuit decides that the vehicle is in deceleration, and operates the fuel cutoff solenoid or fuel injectors to cutoff fuel.

However, when a failure occurs in the system, for example the failure in accelerator switch caused by sticking of a movable contact to a fixed contact or short circuit of a harness to the ground occurs, the result is the same as the release of the accelerator pedal in the normal operating condition of the accelerator switch. If the other switches are also closed, the control circuit decides that the vehicle is decelerating. Therefore, the fuel cutoff solenoid is operated to cutoff fuel in spite of the depression of the accelerator pedal, resulting in stall or surging of the engine, deterioration of driveability of the vehicle

SUMMARY OF THE INVENTION

The object of the present invention is to provide a fuel cutoff system which operates to continue to supply fuel at the deceleration of a vehicle during the failure of a switch, whereby above described troubles can be prevented.

According to the present invention, there is provided a fuel cutoff system for a motor vehicle having an accelerator pedal comprising, sensing means responsive to the operation of the accelerator pedal for producing an accelerator signal having logic levels, one of which is a first level at the depression of the accelerator pedal and the other is a second level at the release of the pedal and the failure of the means, means for detecting the driving state of the motor vehicle and for producing a driving signal, failure detecting means having first and second states, the first state responsive to the accelerator signal of the first signal and to second signal after the first signal for producing an output signal having a first level, and the second state responsive to the accelerator signal of the second level for producing the output signal having a second level, gate means responsive to the accelerator signal, driving signal and output signal for producing a control signal, and fuel supply control means responsive to the control signal for controlling the supply of fuel.

The gate means responds to the accelerator signal of the second level, driving signal and output signal of the first level for producing the control signal for cutting off the fuel, and responds to the accelerator signal of the second level and the output signal of the second level for producing the control signal for supplying the fuel.

In an aspect of the present invention, the sensing means includes an accelerator switch operated by the accelerator pedal, and the failure detecting means is a flip-flop.

The other objects and features of this invention will be apparently understood from the following description with reference to the accompanying drawings.

DETAILED DESCRIPTION OF THE INVENTION

Figure 1:
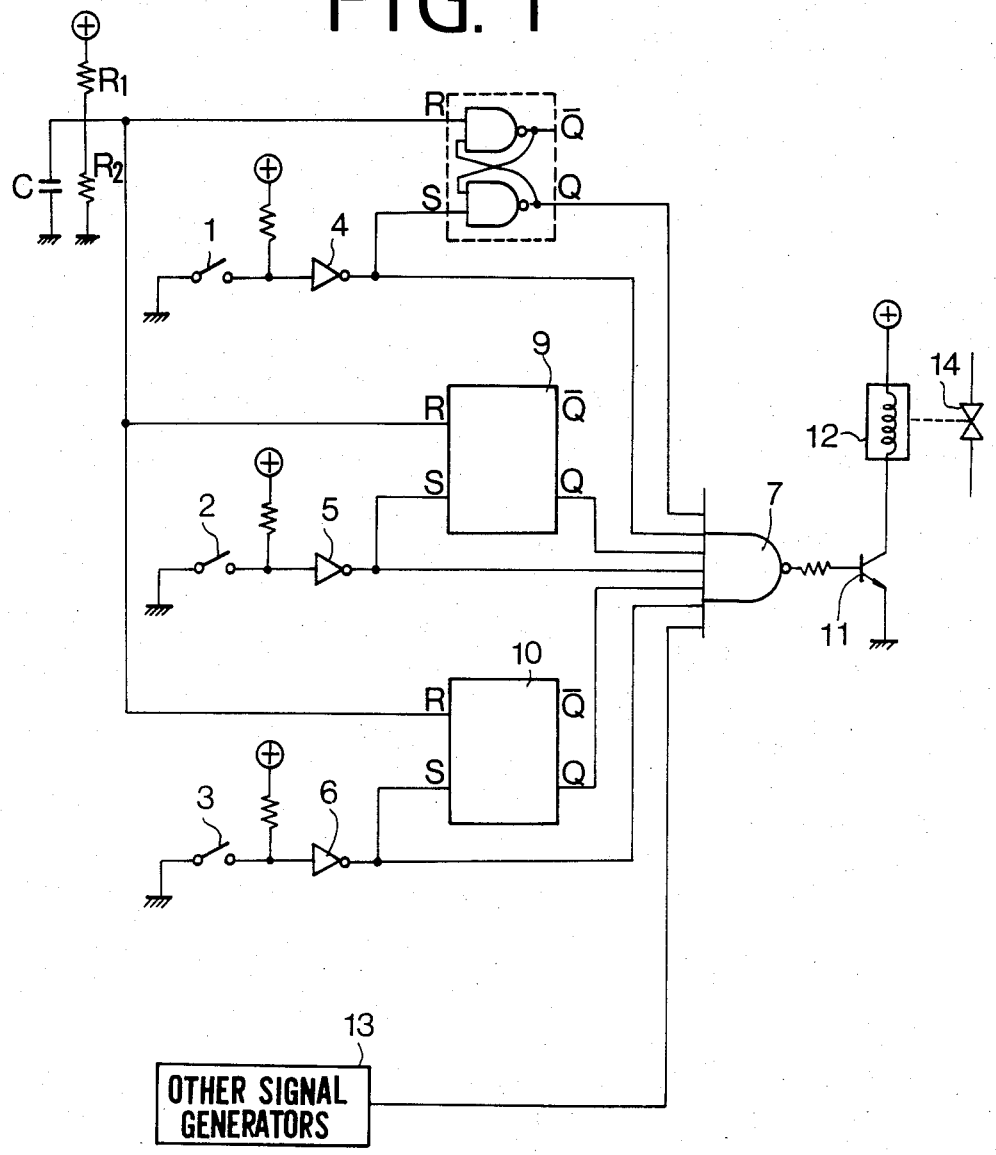
FIG. 1 is a control circuit of a system according to the present invention.
Figure 2:
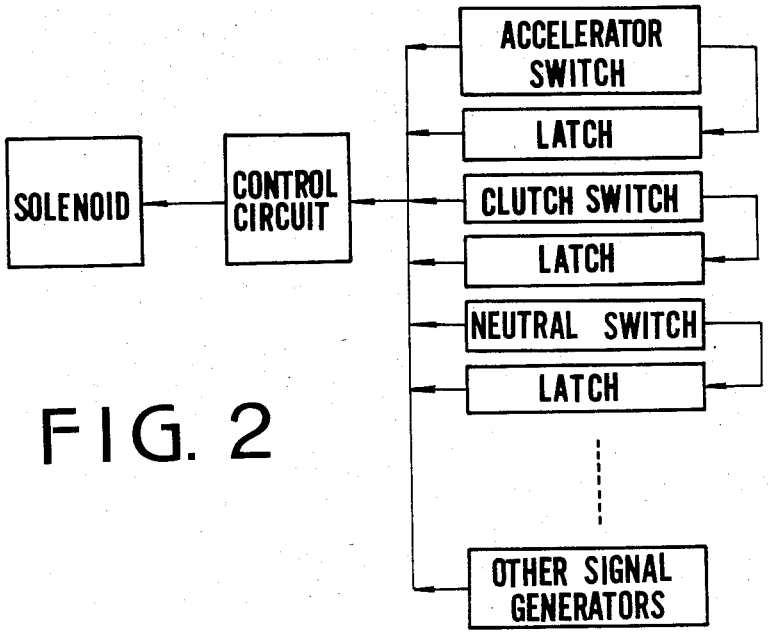
FIG. 2 is a block diagram explaining the principle of the fuel cutoff system according to the present invention.
Figure 3:
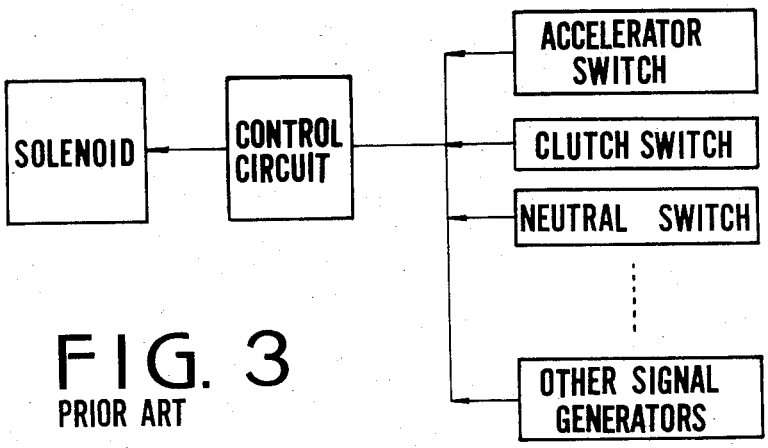
FIG. 3 PRIOR ART
FIG. 3 is a block diagram explaining the principle of a fuel cutoff system in prior art.

Referring to FIGS. 1 and 2, a fuel cutoff system comprises a control circuit including an accelerator switch 1 which is closed when an accelerator pedal of a vehicle is released, a clutch switch 2 which is closed when a clutch pedal is released and a neutral switch 3 which is also closed when one of gears in a transmission is in engagement with another gear, and other signal generators 13, such as a coolant temperature sensor and engine speed sensor. The control circuit has a NAND gate 7 connected to the switches 1, 2 and 3 through inverters 4, 5 and 6, respectively. R-S flip-flops 8, 9 and 10 are provided to be applied with outputs of inverters 4 to 6 at set inputs S.

The reset input R of each flip-flop is applied with a voltage divided by resistors $R_1$, and $R_2$. Outputs of the flip-flops at Q terminals and the output of signal generators 13 are applied to the NAND gate 7. The output of the NAND gate is applied to a base of a transistor 11 which is connected to a fuel cutoff solenoid 12 in series. The solenoid is adapted to operate a fuel cutoff valve 14 provided in an idle system. When the solenoid is de-energized, the valve 14 is closed to cutoff fuel.

The normal operation of the present system is described hereinafter. During starting of the engine, the accelerator switch 1 is opened by the depression of the accelerator pedal, so that the inverter 4 produces a low level output which is applied to the set terminal S of the flip-flop 8 and NAND gate 7. Since the reset terminal R of the flip-flop 8 is applied with a low level input until a capacitor C is charged, the output of the flip-flop 8 is at a high level. However, since the low level output of the inverter 4 is applied to the NAND gate 7, the output thereof is at a high level. Accordingly, the transistor 11 becomes conductive thereby energizing the solenoid 12 to supply fuel. When the capacitor C is charged, the input of the reset terminal of the flip-flop 8 becomes high. However, the flip-flop 8 is latched to produce a high level output.

When the accelerator pedal is released to decelerate the vehicle under the clutch engagement condition (the clutch pedal is released) and the gear engagement condition (the shift lever is at a position other than neutral), switches 1 to 3 are all closed. The set terminal and the reset terminal of the flip-flop 8 are applied with high level inputs so that the output of the flip-flop 8 goes to a high level. The outputs of flip-flops 9 and 10 and inverters 5 and 6 are also at high levels. The signal generator 13 also produces a high level output so that NAND gate 7 produces a low level output thereby to render the transistor 11 non-conductive. Accordingly, the solenoid 12 is de-energized to close the valve 14 to cutoff the fuel.

When the vehicle is accelerated, the accelerator switch 1 is opened, causing the output of the inverter 4 to go to a low level. Since the input of the set terminal of the flip-flop is at a low level and the input of the reset terminal is at a high level, the output of the flip-flop 8 becomes a high level. However, the NAND gate 7 is applied with a low level signal from the inverter 4. Accordingly, the NAND gate 7 produces a high level output and the solenoid 12 is energized to supply fuel.

The operation of the present system when one of the switches, the accelerator switch 1 as an example, is out of order, is described hereinafter. The contact of accelerator switch 1 sticks to the fixed contact so that the switch is kept closed though the accelerator pedal is depressed during starting of the engine. At the starting of the engine, since the input of the set terminal S of the flip-flop 8 is at a high level and the input of the reset terminal R is at a low level, the output of the flip-flop 8 is at a low level. When the input of the reset terminal becomes high, the low level output of the flip-flop 8 does not change. Therefore, NAND gate 7 produces a high level output rendering the transistor 11 conductive, thereby energizing solenoid 12 to supply fuel. It goes without saying that when the vehicle is decelerated, the solenoid remains energized to supply fuel. The system operates in the same way when the clutch switch 2 or the neutral switch 3 is out of order.

FIG. 2 shows the principle of the system. A microcomputer may be employed to control the fuel supply by processing informations from signal generators. In the fuel injection system, it is possible to directly control fuel injectors to cutoff fuel.

From the foregoing, it will be understood that the present invention provides a fuel cutoff system which may continue to supply fuel despite the failure of a signal generator for detecting the deceleration of a vehicle. Accordingly, the stall and surging of the engine and deterioration of driveability can be avoided.

While the presently referred embodiment of the present invention has been shown and described, it is to be understood that this disclosure is for the purpose of illustration and that various changes and modifications may be made without departing from the scope of the invention as set forth in the appended claim.

What is claimed is:

1. A fuel cutoff system for a motor vehicle having an accelerator pedal comprising:

sensing means responsive to the operation of the accelerator pedal for producing an accelerator signal having logic levels, one of which is a first level at the depression of the accelerator pedal and the other is a second level at the release of the pedal and the failure of the means;

means for detecting the driving state of the motor vehicle and for producing a driving signal;

failure detecting means having first and second states, the first state responsive to the accelerator signal of the first signal and to second signals after the first signal for producing an output signal having a first level, and the second state responsive to the accelerator signal of the second level for producing the output signal having a second level;

gate means responsive to the accelerator signal, driving signal and output signal for producing a control signal;

fuel supply control means responsive to the control signal for controlling the supply of fuel;

the gate means being responsive to the accelerator signal of the second level, driving signal and output signal of the first level for producing the control signal for cutting off the fuel, and responsive to the accelerator signal of the second level and the output signal of the second level for producing the control signal for supplying the fuel.

2. The system according to claim 1 wherein the sensing means includes an accelerator switch operated by the accelerator pedal.

3. The system according to claim 1 wherein the failure detecting means is a flip-flop.

* * * * *